United States Patent [19]

Stellaccio

[11] 4,402,709

[45] Sep. 6, 1983

[54] SIMULTANEOUS PRODUCTION OF CLEAN DEWATERED AND CLEAN SATURATED STREAMS OF SYNTHESIS GAS

[75] Inventor: Robert J. Stellaccio, Spring, Tex.

[73] Assignee: Texaco Inc., White Plains, N.Y.

[21] Appl. No.: 372,420

[22] Filed: Apr. 27, 1982

[51] Int. Cl.[3] ..... C10J 3/46; C10J 3/84

[52] U.S. Cl. ..... 48/197 R; 48/206; 48/215; 252/373

[58] Field of Search ..... 48/197 R, 200, 201, 48/206, 215; 252/373

[56] References Cited

U.S. PATENT DOCUMENTS

| | | | |
|---|---|---|---|
| 3,607,157 | 9/1971 | Schlinger et al. | 48/197 R |
| 4,141,696 | 2/1979 | Marion et al. | 48/197 R |
| 4,205,963 | 6/1980 | Marion et al. | 48/197 R |

*Primary Examiner*—Peter F. Kratz

*Attorney, Agent, or Firm*—Carl G. Ries; Robert A. Kulason; Albert Brent

[57] ABSTRACT

The hot raw effluent gas stream from a free-flow partial oxidation gas generator comprising $H_2$, CO, $CO_2$, entrained particulate carbon, and at least one material from the group $H_2O$, $N_2$, Ar, $H_2S$, COS, $CH_4$, and ash are split into two hot raw gas streams which are separately processed. One hot, raw split gas stream contains about 5 to 50 volume %, such as 10 to 20 volume % of the total amount of hot raw effluent gas stream and the other hot, raw split gas stream contains the remainder. One raw, split gas stream is cleaned by quenching and scrubbing with water to produce a clean product gas stream saturated with water. The entrained particulate carbon is removed from the raw synthesis gas as a carbon-water dispersion from which it is extracted with a liquid organic extractant. The resulting liquid organic extractant-carbon-water dispersion is vaporized in a vaporizing zone using the sensible heat from the other hot raw split gas stream at substantially the same conditions of temperature and pressure as in the gas generator less ordinary losses in the lines. The particulate carbon is then separated from the gaseous phase by scrubbing with a liquid hydrocarbon fuel to separate out a liquid hydrocarbon fuel- carbon dispersion which may be supplied to the gas generator as a portion of the feed. The remaining gaseous mixture is cooled and separated into a clean dewatered product gas stream, water, and liquid organic extractant. The latter two materials are recycled.

16 Claims, 1 Drawing Figure

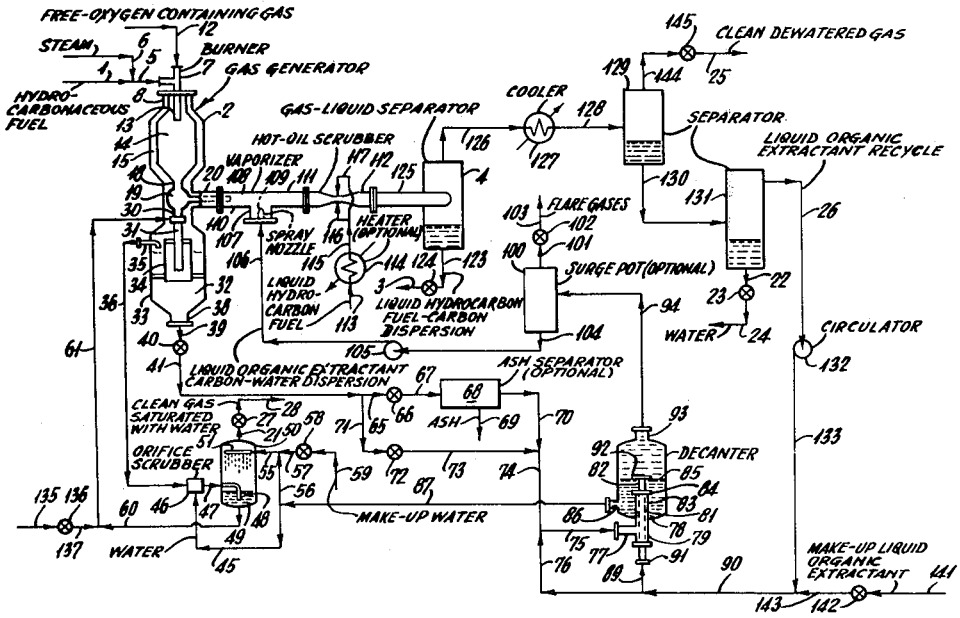

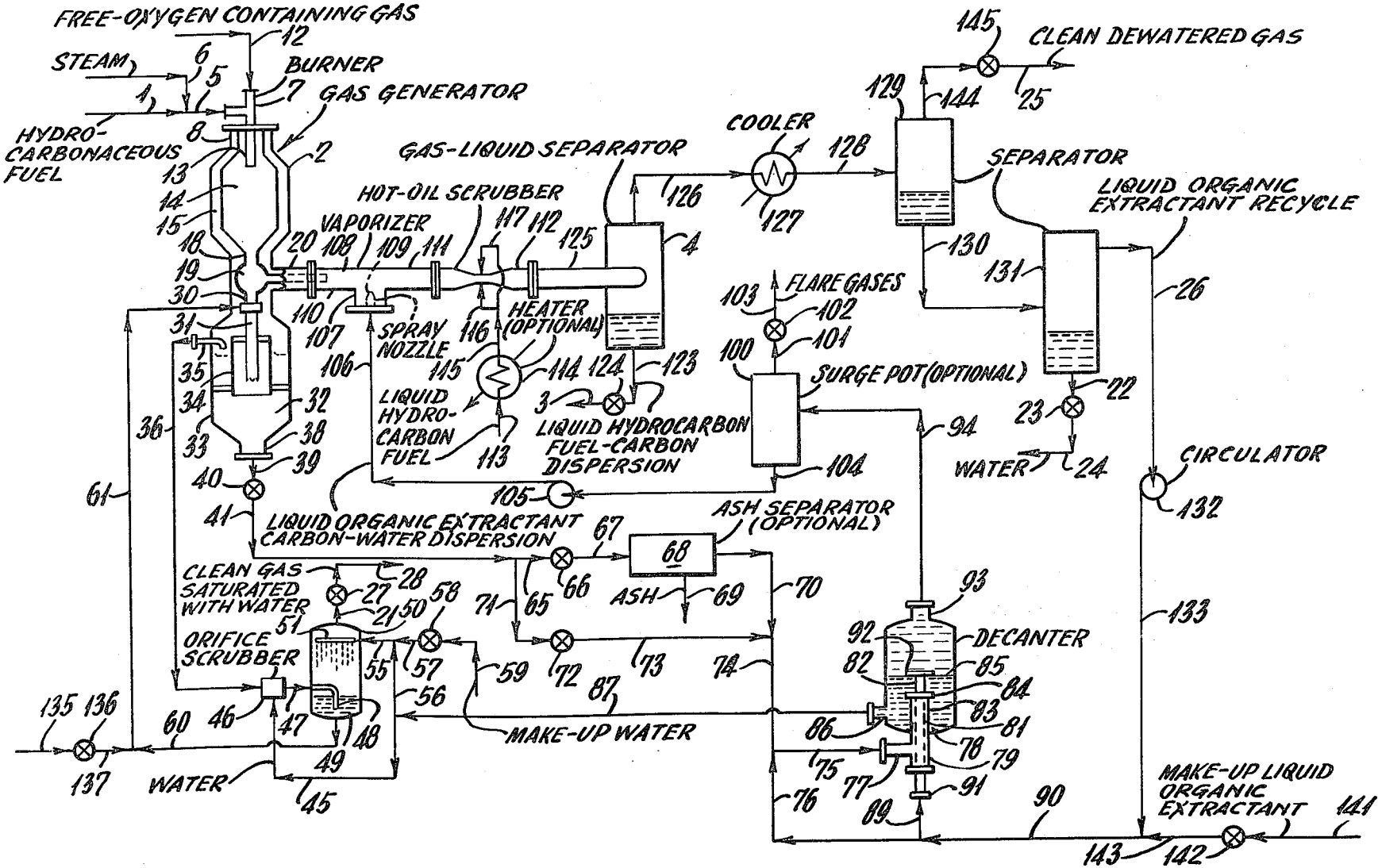
FREE-OXYGEN CONTAINING GAS
STEAM
HYDRO-CARBONACEOUS FUEL
BURNER
GAS GENERATOR
HOT-OIL SCRUBBER
VAPORIZER
GAS-LIQUID SEPARATOR
HEATER (OPTIONAL)
SPRAY NOZZLE
LIQUID HYDRO-CARBON FUEL
LIQUID HYDROCARBON FUEL-CARBON DISPERSION
COOLER
SEPARATOR
CLEAN DEWATERED GAS
LIQUID ORGANIC EXTRACTANT RECYCLE
SURGE POT (OPTIONAL)
FLARE GASES
ASH SEPARATOR (OPTIONAL)
ASH
LIQUID ORGANIC EXTRACTANT CARBON-WATER DISPERSION
CLEAN GAS SATURATED WITH WATER
ORIFICE SCRUBBER
WATER
CIRCULATOR
DECANTER
MAKE-UP WATER
MAKE-UP LIQUID ORGANIC EXTRACTANT

SIMULTANEOUS PRODUCTION OF CLEAN DEWATERED AND CLEAN SATURATED STREAMS OF SYNTHESIS GAS

BACKGROUND OF THE INVENTION

This invention relates to a continuous process for producing clean streams of synthesis or fuel gas by the partial oxidation of a hydrocarbonaceous fuel with a free-oxygen containing gas. More specifically, it relates to an improved procedure for recovering the particulate carbon entrained in the hot raw effluent gas stream from a free-flow noncatalytic partial oxidation gas generator and producing a clean dewatered stream of synthesis or fuel gas and a separate clean stream of synthesis gas saturated with $H_2O$.

Raw effluent gas leaving a partial oxidation gas generator may comprise principally CO, $H_2$, $CO_2$ and $H_2O$ together with other gaseous impurities and minor amounts of entrained finely divided carbon and ash. The particulate carbon is commonly referred to as soot. Cleaning and purifying the raw effluent gas to produce synthesis gas or fuel gas usually starts with the removal of the particulate carbon and any other entrained solids. This will extend the life of any catalyst or solvent that may be later contacted by the process gas stream. Synthesis gas is important commercially as a source of feed gas for the synthesis of hydrocarbons or oxygen containing organic compounds, or for producing hydrogen or ammonia.

Entrained particulate carbon may be removed from the raw effluent gas by quenching and scrubbing with water such as described in coassigned U.S. Pat. No. 3,232,728. Cleaning the effluent gas by scrubbing with an oil-carbon slurry is described in coassigned U.S. Pat. No. 3,639,261. Recovery of the particulate carbon from carbon-water dispersions by the steps of adding a light oil to the carbon-water dispersion, separating water and light oil-carbon dispersion in a decanter, mixing the light oil-carbon dispersion with heavy oil and heating in a preheater, and vaporizing the light oil in a flash drum or distillation tower is described in coassigned U.S. Pat. Nos. 2,999,741; 2,992,906; 3,044,179; and 4,134,740. However, in these processes in contrast with the subject process, there is no direct contact between the liquid organic extractant-carbon-water dispersion and the main source of heat. Accordingly, the subject process is more thermal efficient and eliminates costly equipment, i.e. distillation towers, coolers, and flash separators. Typical decanting procedures are described in coassigned U.S. Pat. Nos. 3,980,592 and 4,014,786.

SUMMARY

This is a continuous process for simultaneously producing two separate clean streams of synthesis or fuel gas. Each stream comprises $H_2$, CO, $CO_2$, and at least one material from the group $H_2O$, $N_2$, Ar, $H_2S$, COS, and $CH_4$. One gas stream is dewatered while the other is saturated with $H_2O$. By-product particulate carbon is also obtained, preferably as a slurry of particulate carbon dispersed in liquid hydrocarbon fuel.

In the process all of the hot raw effluent gas stream leaving the reaction zone of a free-flow noncatalytic partial oxidation synthesis gas generator at a temperature in the range of about 1700° to 3500° F. and a pressure in the range of about 5 to 300 atmospheres is split into first and second hot raw gas streams. The first hot raw gas stream comprises in the range of about 5 to 50 volume percent, such as 10 to 20 volume percent of the total effluent gas, and the second hot raw gas stream comprises the remainder. The second hot raw gas stream is directly contacted with water in gas quenching and scrubbing zones to produce a stream of cooled and cleaned gas saturated with $H_2O$ and a stream of carbon-water dispersion. The gas stream may be directly introduced into a gas turbine as fuel. In one embodiment, the saturated gas stream may be employed as a feedstream to a catalytic water-gas shift reaction zone where CO and $H_2O$ in the gas stream are reacted to increase the $H_2$ content of the gas stream. Alternatively, the saturated gas stream may be dewatered for use as synthesis or fuel gas. The carbon-water dispersion is resolved by mixing it with a liquid organic extractant, and separating in a decanting zone a stream of liquid organic extractant-carbon-water dispersion and a stream of clarified water. At least a portion of the clarified water is then recycled to the quench and scrubbing zones.

The stream of liquid organic extractant-carbon-water dispersion in liquid phase is directly contacted in a vaporizing zone with the first hot raw gas stream at substantially the same temperature and pressure as that in the reaction zone of the gas generator less ordinary drop in the lines. By this direct heat exchange, thermal efficiency of the process is maximized. All of the water and the liquid organic extractant are vaporized in the vaporizing zone which is kept below a temperature of 1000° F., such as in the range of about 300° F. to 700° F., say 450° to 550° F. to minimize undesirable side reactions such as cracking or reactions of the liquid organic extractant with steam or $H_2$ and CO in the synthesis gas. Particulate carbon entrained in the vaporized mixture is then removed from the gaseous phase by scrubbing with a liquid hydrocarbon fuel in a gas-liquid contacting zone such as a venturi scrubber. Then, in a gas-liquid separator, a liquid hydrocarbon fuel-carbon dispersion stream is separated from a gaseous phase comprising the first gas stream in admixture with vaporized liquid organic extractant and $H_2O$. The liquid hydrocarbon fuel-carbon dispersion stream may be introduced into the gas generator as at least a portion of the fuel feed. By this means the by-product carbon soot may be used as a reactant to achieve ultimate conversion to synthesis gas. The gaseous phase is cooled, liquefied, and separated into a stream of clean dewatered synthesis or fuel gas, a stream of liquid organic extractant, and stream of water. At least a portion of the liquid organic extractant is recycled to the decanting zone for mixing with the carbon-water dispersion. At least a portion of the separated water is recycled to the gas quenching and scrubbing zone.

BRIEF DESCRIPTION OF THE DRAWING

The invention will be further understood by reference to the accompanying drawing. The drawing is a schematic representation of a preferred embodiment of the process.

DESCRIPTION OF THE INVENTION

In the subject process, a raw gas stream, substantially comprising $H_2$, CO, $CO_2$, entrained particulate carbon and at least one material from the group $H_2O$, $N_2$, Ar, $H_2S$, COS, $CH_4$, and ash is produced by partial oxidation of a hydrocarbonaceous fuel with a free-oxygen containing gas, typically in the presence of a temperature moderator, in the reaction zone of an unpacked free-flow noncatalytic partial oxidation gas generator. When steam is used as the temperature moderator the steam-to-fuel weight ratio in the reaction zone is in the range of about 0.1 to 5, and preferably about 0.2 to 0.7. The atomic ratio of free oxygen to carbon in the fuel (O/C ratio), is in the range of about 0.6 to 1.6, and preferably about 0.8 to 1.4. The reaction time is in the range of about 0.1 to 50 seconds, and preferably about 2 to 6 seconds.

The synthesis gas generator comprises a vertical cylindrically shaped steel pressure vessel lined with refractory, such as shown in coassigned U.S. Pat. No. 2,809,104. A typical quench drum is also shown in said patent. A burner, such as shown in coassigned U.S. Pat. No. 2,928,460, may be used to introduce the feed streams into the reaction zone.

A wide range of combustible carbon-containing organic materials may be reacted in the gas generator with a free-oxygen containing gas, optionally in the presence of a temperature-moderating gas, to produce the synthesis gas.

The term hydrocarbonaceous as used herein to described various suitable feedstocks is intended to include gaseous, liquid, and solid hydrocarbons, carbonaceous materials, and mixtures thereof. In fact, substantially any combustible carbon-containing organic material, or slurries thereof, may be included within the definition of the term "hydrocarbonaceous." For example, there are (1) pumpable slurries of said carbonaceous fuels, such as coal, particulate carbon, petroleum coke, concentrated sewer sludge, and mixtures thereof, in a vaporizable liquid carrier, such as water, liquid $CO_2$, liquid hydrocarbon fuel, and mixtures thereof; (2) gas-solid suspensions such as finely ground solid carbonaceous fuels dispersed in either a temperature-moderating gas or in a gaseous hydrocarbon; and (3) gas-liquid-solid dispersions, such as atomized liquid hydrocarbon fuel or water and particulte carbon dispersed in a temperature moderating gas. The hydrocarbonaceous fuel may have a high sulfur content but is typically in the range of about 1 to 10 wt. percent and an ash content in the range of about 0 to 60 wt. percent.

The term liquid hydrocarbon, as used herein to describe suitable liquid hydrocarbon feedstocks to the gasifier, is intended to include various materials, such as liquefied petroleum gas, petroleum distillates and residua, gasoline, naphtha, kerosine, crude petroleum, asphalt, gas oil, residual oil, tarsand oil and shale oil, coal derived oil, aromatic hydrocarbons (such as benzene, toluene, xylene fractions), coal tar, cycle gas oil from fluid-catalytic-cracking operations, furfural extract of coker gas oil, and mixtures thereof.

Gaseous hydrocarbon fuels, as used herein to describe suitable gaseous feedstocks, include methane, ethane, propane, butane, pentane, natural gas, water-gas, coke-oven gas, refinery gas, acetylene tail gas, ethylene off-gas, synthesis gas, and mixtures thereof. Solids, gaseous, and liquid feeds may be mixed and used simultaneously; and these may include paraffinic, olefinic, acetylenic, naphthenic, and aromatic compounds in any proportion.

Also included within the definition of the term hydrocarbonaceous are oxygenated hydrocarbonaceous organic materials including carbohydrates, cellulosic materials, aldehydes, organic acids, alcohols, ketones, oxygenated fuel oil, waste liquids and by-products from chemical processes containing oxygenated hydrocarbonaceous organic materials and mixtures thereof.

The hydrocarbonaceous feed may be at room temperature, or it may be preheated to a temperature up to as high as about 600° to 1200° F. but preferably below its cracking temperature. The hydrocarbonaceous feed may be introduced into the gas-generator burner in liquid phase or in a vaporized mixture with the temperature moderator.

The need for a temperature moderator to control the temperature in the reaction zone of the gas generator depends in general on the carbon-to-hydrogen ratios of the feedstock and the oxygen content of the oxidant stream. A temperature moderator is used with liquid hydrocarbon fuels and with substantially pure oxygen. Water or steam is the preferred temperature moderator. Steam may be introduced as a temperature moderator in admixture with either or both reactant streams. Alternatively, the temperature moderator may be introduced into the reaction zone of the gas generator by way of a separate conduit in the burner. Other temperature moderators include $CO_2$-rich gas, nitrogen, and recycled synthesis gas.

The term free-oxygen containing gas as used herein means air, oxygen-enriched-air i.e. greater than 21 mole % $O_2$, and substantially pure oxygen, i.e. greater than about 95% mole oxygen (the remainder usually comprising $N_2$ and rare gases). Free-oxygen containing gas may be introduced by way of the partial-oxidation burner at a temperature in the range of about ambient to 1800° F.

The raw gas stream exits from the reaction zone at a temperature in the range of about 1700° to 3500° F., and preferably 2000° to 2800° F., and at a pressure in the range of about 5 to 300 atmospheres, and preferably 15 to 150 atmospheres. The composition of the hot raw effluent gas stream is about as follows, in mole percent: $H_2$ 10 to 70, CO 15 to 57, $CO_2$ 0.1 to 25, $H_2O$ nil to 20, $CH_4$ nil to 60, $H_2S$ nil to 2, COS nil to 0.1, $N_2$ nil to 60, and Ar, nil to 2.0. Particulate carbon is present in the range of about 0.2 to 20 weight % (basis carbon content in the original feed). Ash and/or slag may be present in the amount of about nil to 60 weight % of the original hydrocarbonaceous feed. Depending on the composition after removal of the entrained particulate carbon and any ash and/or slag in the manner described below and with or without dewatering, the gas stream may be employed as synthesis gas, reducing gas, or fuel gas.

In the subject process all of the hot raw effluent gas stream leaving the refractory lined reaction zone of the partial oxidation gas generator is passed directly into a thermally insulated refractory lined clamber and split into separate first and second hot raw gas streams. The first and second split streams of hot raw gas are passed through separate thermally insulated lines and are then simultaneously processed in first and second trains, respectively. The first split stream of hot raw gas comprises in the range of about 5 to 50 % vol.%, such as 10 to 20 vol.%, say 15 volume percent of the total effluent gas stream from the gasifier; and, the second and usually larger split stream of hot raw gas comprises the remainder.

All of the second split stream at substantially the same temperature and pressure as in the reaction zone, less ordinary drop in the lines is directly introduced into a pool of water contained in the bottom of a quench drum or tank such as described in coassigned U.S. Pat. No. 2,896,927 which is herewith incorporated by reference.

The quench drum is located below the reaction zone of the gas generator, and the second split stream of raw gas which it receives carries with it substantially all of the ash and/or slag and a substantial part of the particulate-carbon soot leaving the reaction zone of the gas generator. The turbulent condition in the quench drum, caused by large volumes of gases bubbling up through the water helps the water to scrub substantially all of the solids from the effluent gas. Large quantities of steam are generated within the quench vessel and saturate the gas stream. The second split stream of gases is cooled in the quench drum and leaves at a temperature in the range of about 300° F. to 600° F.

In order to prevent plugging downstream catalyst beds and/or contaminating liquid-solvent absorbents that may be used in subsequent gas-purification steps, the cooled and cleaned gas stream leaving the quench drum may be further cleaned by contact with a scrubbing fluid in a secondary gas cleaning zone in the second train. The secondary gas cleaning zone may include conventional orifice and venturi scrubbers and sprays by which the second split stream of gases is scrubbed with clarified or reclaimed water from a decanting zone to be further described. The scrub water contains less than about 0.1 wt. % solids and another portion may be preferably recycled to the quench drum. By this gas cleaning procedure, the amount of solid particles in the second split gas stream may be reduced to less than about 3 parts per million (PPM), and preferably less than about 1 PPM. Advantageously, since this cooled and cleaned product gas stream is saturated with $H_2O$ it may be introduced directly into a gas turbine as fuel gas where it is desired to reduce the $NO_x$ content of the exhaust gas. Alternatively, this cooled cleaned product gas saturated with $H_2O$ may be introduced directly into a conventional catalytic water-gas shift converter to increase the $H_2/CO$ mole rate of the stream of synthesis or to produce $H_2$-rich gas.

A dispersion is produced in the quench tank substantially comprising quench water and about 0.1 to 4.0 wt.% such as about 0.5 to 2.5 wt.% of particulate carbon containing solids. Depending on the composition of the fuel, a relatively small amount of ash may be present in the dispersion. Further, any unburned inorganic solids such as coarse ash and/or slag from solid fuels and any refractory from the gasifier may accumulate at the bottom of the quench tank. Periodically, this material may be removed and a stream of carbon-water dispersion may be separated from ash and/or slag by conventional means i.e. gravity settling, flotation, centrifuge, or filtration.

The dispersion of carbon-water produced in the second train is resolved by being introduced in admixture with a suitable liquid organic extractant such as light liquid hydrocarbons i.e. naphtha into a carbon separation zone. In this manner, the carbon may be recovered and recycled to the gas generator as a portion of the fuel, and the water may be recycled to the gas quenching and scrubbing zones. Conventional horizontal and vertical decanters may be employed. The liquid organic extractant may be added in one or two stages. A description of suitable vertical decanters, liquid organic extractants, and methods of operation are described in coassigned U.S. Pat. No. 4,014,786, which is incorporated by reference.

In one embodiment of the subject process as shown in the drawing, a two-stage decanting operation is used. A first portion of the liquid organic extractant recovered downstream in the process is mixed with all of the carbon-water dispersion. The amount of liquid organic extractant is sufficient to resolve the carbon-water dispersion. The amount may be in the range of about 1.5 to 15 lbs. of extractant per lb. of carbon. The mixture is then introduced into the first stage of a two-stage decanting operation. Simultaneously, a second portion of the liquid organic extractant in an amount sufficient to produce a pumpable liquid organic extractant-carbon-water dispersion having a solids content in the range of about 0.5 to 9 wt. % is introduced into the second stage. The residence time in the decanter may be in the range of about 2 to 20 minutes, say 6 to 15 minutes.

Suitable liquid organic extractants that form dispersions with the particulate carbon and which are lighter than and immiscible with water include: (1) light liquid hydrocarbon fuels having an atmospheric boiling point in the range of about 100° to 450° F., say about 125° to 375° F., density in degrees API in the range of over 20 to about 100, and a carbon number in the range of about 5 to 16; (2) a mixture of substantially water insoluble liquid organic by-products from an oxo or oxyl process; and (3) mixtures of types (1) and (2). Examples of type (1) liquid extractants include butanes, pentanes, hexanes, toluol, natural gasoline, gasoline, naphtha, gas oil, their mixtures and the like. Ingredients in the mixture comprising type (2) extractants include at least one alcohol, at least one ester and at least one constituent from the group consisting of aldehydes, ketones, ethers, acids, olefins, and saturated hydrocarbons.

The particulate carbon in the carbon-water dispersion that is introduced into the decanter is in the form of free-carbon black or soot. The Oil Absorption No. of the carbon soot, as determined by ASTM Method D-281, is greater than 1 and usually varies from 2 to 4 cc of oil per gram of C. The inorganic ash from the oil in these dispersions comprises metals and the sulfides. For example, for petroleum derived fuels these components may be selected from the group Ni, V, and Fe, and mixtures thereof. Further, for such fuels the amount of soluble impurities in the dispersions of water-particulate solids comprise in parts per million (PPM): ammonia 0 to 10,000; formate 0 to 10,000; sodium chloride 0 to 5000; nickel 0 to 25; iron 0 to 150; sulfide 0 to 500; and cyanide 0 to 100.

The decanter is operated at a temperature in the range of about 180° F. to 650° F. and preferably about 250° F. The pressure in the decanter is in the range of about 75 to 4500 psig, such as about 75 to 600 psig, say about 75 to 400 psig, and must be high enough to keep the liquid organic extractant in a liquid phase. Thus, when the decanter bottoms outlet temperature at 300° F., and the liquid organic extractant is naphtha, the pressure in the decanter may be at least 300 psia. The total amount of liquid organic extractant that may be introduced into a one or two-stage decanting operation is in the range of about 10 to 200 times, such as 30 to 70 times, the weight of the particulate carbon in the carbon-water dispersion.

The stream of clarified water resulting from the resolution of the carbon-water dispersion in the decanter comprises about 100 to 500 parts per million by weight of particulate carbon and contains about 20 to 60 wt. % of any ash present. The clarified water separates out by gravity and leaves at the bottom of the decanter. A dispersion stream of liquid organic extractant-carbon-water in liquid phase is removed from the upper section of the decanter substantially comprising about 0.5 to 9 wt.%, say over 2.5 to 4.5 wt.% of particulate carbon, about 0.5 to 10 wt.% water, and the remainder liquid organic extractant. The streams of clarified water and the liquid organic extractant-carbon-water dispersion may leave the decanter at a temperature in the range of about 180° F. to 650° F., such as about 250° to 350° F.

Returning now to the first split stream of hot raw effluent gas being processed in the first train, all of the first split stream is directly introduced at substantially the same temperature and pressure as in the reaction zone of the gas generator, less ordinary drop in the lines into a thermally insulated vaporizer. The expression "ordinary drop in the lines" means by definition a temperature drop that does not exceed 100° F. and a pressure drop that does not exceed 30 psig. The vaporizer may comprise a hollow "T" action lined on the inside with a thermal refractory material and having two inlets and one outlet. No supplemental thermal energy is externally applied to the vaporizer.

The liquid phase dispersion of liquid organic extractant-carbon-water from the decanter in the second train is introduced into the vaporizer in the first train. The dispersion of liquid organic extractant-carbon-water with or without degassing is introduced into the vaporizer preferably at substantially the same temperature and pressure so that in the decanter less ordinary drop in the lines. No pressure drop is necessary or recommended to effect vaporization of this stream. Within the vaporizer, the dispersion of liquid organic extractant-carbon-water is atomized and then comes in direct contact and is intimately mixed with the first split hot raw gas stream passing through. All of the energy required by the liquid stream of liquid organic extractant-carbon-water to be converted from the liquid to gaseous phase is provided by the thermal energy in the first split hot raw gas stream. The first split hot raw gas stream is preferably introduced into the vaporizer at substantially the same temperature and pressure as in the reaction zone of the gas generator less ordinary drop in the lines. To avoid undesirable side reactions such as cracking or reactions between steam, $H_2$ and CO in the synthesis gas and the liquid organic extractant in the vaporizer while assuring complete vaporization of the water and liquid organic extractant, the vaporizer is maintained at a critical temperature of below 1000° F. and above the dew points of $H_2O$ and the liquid organic extractant in the vaporizer such as in the range of about 300° F. to 700° F., say 450° F. to 550° F. The partial pressure of liquid organic extractant-carbon-water dispersion in the vaporizer is maintained below the vapor pressure of the dispersion components at the above temperatures so that complete vaporization and optionally some superheating, i.e., 50°–200° F. superheat can occur. In one embodiment, the operating pressure in the vaporizer is in the range of about 75 to 2000 psig., such as about 200 to 1000 psig., say 800 psig. About 0.1 to 1.0 lbs., such as about 0.3 to 0.6 lbs. of the first split hot raw gas stream may be required to vaporize each pound of liquid organic extractant-carbon-water dispersion.

Accordingly, by direct heat exchange, the liquid organic extractant-carbon-water atomized dispersion is vaporized with minimal side reaction in the vaporizer by absorption of the sensible heat from the first split hot raw gas stream. By this means a gaseous mixture containing entrained particulate carbon is produced in the vaporizer, preferably with substantially no reduction in pressure.

In a preferred embodiment, entrained particulate carbon is removed from the gaseous stream leaving the vaporizer by scrubbing the gaseous stream with a liquid hydrocarbon fuel scrubbing fluid which is preferably preheated to a temperature in the range of the vaporizer temperature i.e. 300° F. to 700° F., but below its initial boiling point. The liquid hydrocarbon fuel scrubbing fluid has a density in degrees API of 10 or less, and an initial boiling point in the range of about 400° to 800° F., such as over 500° to 600° F., when measured at atmospheric pressure in accordance with standard test methods of the American Society For Testing and Materials. Suitable liquid hydrocarbon fuel scrubbing fluids may be selected from the group comprising fluid residua from petroleum distillation and cracking process operations, petroleum distillate, reduced crude, whole crude, asphalt, coal tar, coal derived oil, shale oil, tar said oil, and mixtures thereof. Pumpable slurries of solid carbonaceous fuels, e.g. particulate carbon, petroleum coke, and mixtures thereof in a liquid hydrocarbon fuel such as one previously listed are included within the definition of liquid hydrocarbon fuel scrubbing fluid.

About 1 to 10 gallons of liquid hydrocarbon fuel scrubbing fluid may be employed in the scrubber per 1000 cubic feet of gaseous stream from the vaporizer. A conventional orifice or venturi-type scrubber may be used. The scrubbing operation should preferably take place at a temperature above the dew point of the vaporized liquid organic extractant or $H_2O$ whichever is greater and below the initial boiling point of the liquid hydrocarbon fuel scrubbing fluid in the scrubber. By this means vaporized liquid organic extractant and scrubbing fluid losses are minimized and the production of wet soot which is difficult to separate is avoided. During gas scrubbing, the liquid organic extractant is in the vapor phase while the liquid hydrocarbon fuel scrubbing fluid is in the liquid phase. The scrubbing fluid coats the entrained carbon particles. In the next step, in a gas-liquid separator, a liquid hydrocarbon fuel-carbon dispersion may be easily separated by gravity as a liquid and removed from the bottom of the gas-liquid separator. Preferably, the temperature and pressure within the scrubber and gas-liquid separator are substantially the same. At least a portion, and preferably all of the stream of liquid hydrocarbon fuel-carbon dispersion which is produced at a temperature in the range of about 300° F. to 700° F. is recycled to the gas generator as at least a portion of the fuel. Alternatively, at least a portion of this dispersion may be recycled to the scrubber as at least a portion of the liquid hydrocarbon fuel scrubbing fluid, or exported as fuel. If necessary, additional gas cleaning steps may be employed.

The gaseous stream which is removed from the top of the gas-liquid separator substantially comprises the mixture of the scrubbed first split gas stream, vaporized liquid organic extractant, and steam. There may be from about 0 to 5 mole % of normally liquid organic material, for example such as that derived from the liquid hydrocarbon fuel scrubbing fluid, in this gaseous stream. However, in the preferred embodiment there is none. The gaseous stream is then cooled below the dew points of $H_2O$ and the vaporized liquid organic extractant and introduced into a gas-liquid separator where separation of the constituents takes place by gravity settling. A mixture of liquid organic extractant and water in liquid phase is drawn off from the bottom of the gas-liquid separator and allowed to settle. Since the liquids are immiscible, the water is easily separated from the liquid organic extractant by gravity settling and recycled to the quench cooling and scrubbing zones. At least a portion, such as 90–100 vol. %, of the separated liquid organic extractant is recycled back to the decanter along with any make-up liquid organic extractant. The small amount, if any, of normally liquid organic material, such as that derived from the liquid hydrocarbon fuel scrubbing fluid, that may separate out during the aforesaid cooling of the gaseous stream may or may not be recycled back to the decanter along with the liquid organic extractant. A stream of clean dewatered product gas is removed from the top of the gas-liquid separator and may contain less than about 1–3 PPM of entrained particulate matter. The gas stream may be employed as synthesis gas, reducing gas, or fuel gas. Preferably, the clean dewatered product gas stream and the clean product gas stream saturated with water are produced at substantially the same pressure as that in the gas generator less ordinary pressure drop in the lines and equipment, i.e. less than 50 psig. pressure drop.

Advantageously, significant savings result in the subject process by the elimination of equipment normally employed or by size reduction. For example, because in the subject process 5 to 50 volume % of the hot raw effluent gas stream from the gasifier is cooled by vaporizing the decanter overhead stream, the quench drum employed in cooling the second split hot raw gas stream may be smaller and quench water requirements are reduced. This permits the decanter to be scaled down, and a reduction in the amount of liquid organic extractant used. There is also a smaller soot-load to the decanter because the particulate carbon entrained in the first split hot raw gas stream is separated by hot oil scrubbing. Further, fractionation equipment that is used in conventional systems to recover extractant and carbon and which require fired heaters with their additional fuel requirements, and associated energy losses are completely eliminated by the subject process. In addition, costly pressure drop control valves and pressure sensors are eliminated with attendant instrumentation and feed back control loop.

Comparatively low cost circulators that utilize less energy can be used in the subject process in place of expensive liquid pumps. This is because flashing with attendant pressure drop in the lines is avoided by the subject process. Further, clean streams of product gas are produced at substantially the same pressure as the gas generator, less ordinary pressure drop in the lines. By running the gas generator at high pressure, the product gas may be produced at high pressure, thereby eliminating costly gas compressors.

DESCRIPTION OF THE DRAWING

A more complete understanding of the invention may be had by reference to the accompanying drawing.

A reactant feedstream of hydrocarbonaceous fuel in line 1 is introduced into free-flow noncatalytic partial oxidation gas generator 2. Gasifier 2 is a refractory-lined, vertical, steel pressure vessel. The hydrocarboneous feedstream may comprise a portion of fresh liquid hydrocarbon feedstock and at least a portion of the dispersion of particulate carbon and a heavy liquid hydrocarbon fuel from line 3. The later dispersion comprises the bottoms from gas-liquid separator 4. The hydrocarbonaceous fuel feed, with or without preheat, is mixed in line 5 with a temperature moderator such as steam from line 6. The mixture is passed through one passage of conventional annulus-type partial oxidation burner 7 mounted in the upper closed section 8 of gas generator 2. Simultaneously, a reactant feedstream of free oxygen containing gas in line 12 is passed through another passage in burner 7.

The reactant feedstreams are discharged from the downstream outlet 13 of burner 7 and react together by partial oxidation in unobstructed reaction zone 14 which is lined with refractory 15. The hot raw effluent stream of gas leaves from the bottom of the vertical reaction zone. It passes through exit passage 18 and directly into an insulated chamber 19 where the effluent gas stream is split into two gas streams of different quantities. The first split stream, for example carrying the smaller amount of gas, passes through thermally insulated transfer line 20 into the first train of process steps which ends with the production of a clean dewatered gas stream in line 25, a stream of liquid organic extractant in line 26, and a stream of water in line 24, and a stream of liquid hydrocarbon fuel-carbon dispersion in line 3. The second split stream carrying the remainder of the hot raw effluent gas produced passes directly into a second train of process steps which ends with the production of clean gas saturated with $H_2O$ in line 28. The second split stream of hot raw effluent gas carrying the larger amount of the gas produced passes directly through thermally insulated line 30, dip tube 31, and into water 32 in tank 33. The hot raw effluent gas in the second split stream is cooled and scrubbed by the quench water as it passes up through draft tube 34 and leaves by outlet 35 near the top of quench tank 33 and line 36. Water enters quench tank 33 by way of line 61. A water dispersion of solid particles of carbon and ash is continuously removed by way of exit port 38, line 39, valve 40, and line 41 at the bottom of the quench tank. This removal may also be periodically done by means of a conventional lock hopper system (not shown).

Any entrained particulate matter remaining in the effluent gas stream in line 36 may be removed by scrubbing with clarified water from line 45 in orifice scrubber 46. The scrubber gas passes through line 47, dip tube 48, and into water 49 in the bottom of gas-water separator 50. The stream of clean saturated product gas is given a final rinse with water from shower or wash tray 51 and leaves through line 21, valve 27 and line 28 at the top of separator 50. The rinse water enters through line 55 and comprises clarified water from line 56 with or without make-up water from link 57, valve 58 and line 59. Water 49 is recycled to quench tank 33 by way of lines 60 and 61.

It is economically advantageous by means of the subject process to recover the particulate carbon in the water dispersion in line 41. Preferably, the particulate carbon is recycled to the gas generator as a portion of the feed. Further, the liquid organic extractant employed in the process is recovered and reused. Any ash present in the water dispersion may be removed by passing the dispersion in line 41 through line 65, valve 66, line 67 and into ash separator 68. Ash leaves separator 68 by line 69 and carbon-water dispersion leaves by line 70. The carbon-water dispersion in line 71 is passed through valve 72, lines 73 and 74 and mixed in line 75 with liquid organic extractant from line 76. The mixture in line 75 passes through inlet 77 of two-stage decanter 78, into conduit sub-assembly 79, up through the annular passage 81 between inner pipe 82 and outer pipe 83, and out through lower horizontal radial nozzle 84. The particulate carbon floats to interface level 85. Clarified water settles out by gravity below the interface level;

and, it is continuously drawn off through bottom outlet 86 and line 87. A portion of this water may then be recycled to scrubber 46 through line 45 with or without purification. A second portion of the clarified water in line 87 may be recycled to shower or wash tray 51 by way of lines 56 and 55. Additional preheated liquid organic extractant from lines 89 and 90 passes up through inlet 91, inner pipe 82, and is discharged through upper horizontal radial nozzle 92. This liquid organic extractant picks up the particulate carbon at interface 85 and carries it out of decanter 78 through upper outlet 93 and line 94 as a liquid organic extractant-carbon-water dispersion.

Any absorbed gases in the dispersion in line 94 may be optionally removed in surge pot 100. Flare gases may separate and leave by way of line 101, valve 102, and line 103 at the top of surge pot 100. Liquid organic extractant-carbon-water dispersion in line 104 at the bottom of surge pot 100 is passed by means of circulator 105 through line 106 into inlet 107 of vaporizer 108. By means of spray nozzle 109, the dispersion stream is atomized. It then is intimately mixed with the first split stream of hot raw effluent gas which enters vaporizer 108 through inlet 110 at substantially the same temperature and pressure as that in gas generator 2, less ordinary losses in the lines. Further complete vaporization of the liquid constituents of the dispersion takes place with minimal side reactions of the liquid organic extractant. The stream of vaporized carbon dispersion leaves vaporizer 108 through outlet 111. It is then passed through hot oil scrubber 112 where carbon particles are coated with liquid hydrocarbon fuel. Preheating may be optionally employed if necessary to reduce the viscosity of the liquid hydrocarbon fuel. Substantially, none of the liquid hydrocarbon fuel is vaporized. Thus, liquid hydrocarbon fuel in line 113 may be preheated by heater 114 and passed through lines 115–117 into the throat of orifice scrubber 112.

The mixture from the hot oil scrubber 112 is passed through inlet 122 of gas-liquid separator 4. A hot stream of liquid hydrocarbon fuel-carbon dispersion separates by gravity and is removed from gas-liquid separator 4 by way of line 123, valve 124, and line 3 at the bottom of separator 4. Preferably, liquid stream 3 is recycled to gas generator 2 as a portion of the hydrocarbonaceous fuel. Alternatively, the liquid hydrocarbon fuel-carbon dispersion may be employed as scrubbing fluid in scrubber 112 or exported as boiler fuel. The gaseous stream leaving through line 126 at the top of separator 4 is cooled in cooler 127 to condense out the normally liquid constituents and passed through line 128 into gas-liquid separator 129. A mixture of liquid organic extractant, minute portion (if any) of normally liquid organic material derived from the liquid hydrocarbon fuel scrubbing fluid, and water falls by gravity to the bottom of separator 129. The mixture of liquids is then passed through line 130 into liquid-liquid separator 131. Water is removed through line 22, valve 23, and line 24 at the bottom of separator 131. Optionally, the water may be recycled to quench tank 33 by way of line 135, valve 136, and lines 137 and 61. Alternatively, the water may be recycled to orifice scrubber 46 or shower 51. A stream of liquid organic extractant and any of said normally liquid organic material is removed by way of line 26 at the top of separator 131 and recycled to decanted 78 by way of circulator 132 and lines 133, 90, 89, and 76. When required, make-up liquid organic extractant may be introduced into the system by way of 141, valve 142, and line 143. A stream of clean, dewatered product gas is removed from the top of separator 129 by way of line 144, valve 145, and line 25.

EXAMPLE

The following example illustrates a preferred embodiment of the continuous process of this invention as shown in the drawing pertaining to the simultaneous production of a clean dewatered stream of synthesis gas and a clean stream of synthesis gas saturated with water. While preferred modes of operation are illustrated, the example should not be construed as limiting the scope of the invention. The process is continuous and the flow rates are specified on an hourly basis for all streams of materials.

The hydrocarbonaceous fuel in line 1 of the drawing comprises 459 pounds of a pumpable liquid hydrocarbon fuel-carbon dispersion from line 3 of the drawing comprising 91.6 wt. % of vacuum resid and the remainder particulate carbon. The hydrocarbonaceous fuel has a gravity of 4.6 degrees API and an Ultimate Analysis in weight percent as follows: C 87.18, H 9.13, N 0.81, S 1.85, O 0.66, and ash 0.37. The hydrocarbonaceous fuel is at a temperature of 272° F. and a pressure of 890 psig and is mixed in line 5 with a stream of 254 lbs. of steam at a temperature of 735° F. and a pressure of 890 psig. The mixture is passed through the annulus of an annulus-type burner. The burner is located in the upper end of a conventional vertical refractory lined freeflow noncatalytic unpacked synthesis gas generator.

Simultaneously, a stream of 380 lbs. of substantially pure oxygen i.e., 99.5 mole % $O_2$ from line 12 at a temperature of 66° F. and a pressure of 890 psig is passed through the center passage of the burner. The two streams impinge, mix and the partial oxidation and other related reactions then take place in the reaction zone of the gas generator. A stream of 22.4 thousand standard cubic feet (SCF measured at 60° F., 14.7 psia) of raw synthesis gas leave the reaction zone of the gas generator at a temperature of 2300° F. and a pressure of 800 psig. The composition of the raw synthesis gas at the exit 18 of reaction zone 14 is shown in Column 1 of Table I. About 36 lbs. of unreacted particulate carbon and about 1.7 lbs. of ash are entrained in the raw synthesis gas.

The raw effluent gas stream leaving the reaction zone is immediately split into two streams at 19. The first split hot raw gas stream comprises 7.0 thousand SCF of raw synthesis gas. The first split stream is diverted from the main stream, passed through insulated passage 20, and processed in a first train. The second split stream comprising the remainder of the hot raw effluent gas stream is simultaneously passed through insulated passage 30 and processed in the second train. The actual split between the two trains may be controlled by back pressure valves in each line.

All of the second split hot raw gas stream is introduced into quench water in a quench tank, carrying with it a proportionate of the entrained particulate matter, i.e., particulate carbon and ash being produced. The second split stream of gas is cooled and cleaned by the quench water and by supplemental scrubbing water to produce the clean product gas stream saturated with $H_2O$ in line 28. The product stream of synthesis gas comprises 23.2 thousand SCF and has the composition shown in Column 2 of Table I.

In two-stage decanter 78, about 5704 lbs. of carbon-water dispersion containing about 26.1 lbs. of particulate carbon from line 74 are mixed in line 75 with about 204.9 lbs. of naphtha from line 76, as the first stage. The naphtha has an API gravity of 40 minimum and is 72 for this example, and an initial boiling point in the range of 75° F. to 190° F., and is 96° F. for this example. The mixture is introduced into decanter 78 by way of annular passage 79 and lower horizontal radial nozzle 84. The particulate carbon is rendered hydrophobic; and, clarified water separates and falls to the bottom of the decanter where it is continuously removed and recycled to the gas scrubbing and quenching zones. A dispersion of liquid organic extractant-carbon-water forms and floats on the water layer. An additional amount of 423.6 lbs. of naphtha are simultaneously introduced at interface 85 by way of upper horizontal radial nozzle 92, as second stage naphtha.

717.8 lbs. of naphtha-carbon-water dispersion is continuously removed from decanter 78 at a temperature of 250° F. and a pressure of 267 psig. This liquid stream comprises in weight % naphtha 87.6, carbon 3.6, and water 8.8. It is optionally degassed and then sprayed into vaporizer 108 where the atomized mixture comes in direct contact with all of the first split raw hot gas stream. The pressure in vaporizer 108 is substantially the same as that in gas generator 2, less ordinary pressure drop in the lines and equipment. The vaporizer is maintained at a temperature in the range of 450° to 500° F. By direct heat exchange, the naphtha-carbon-water dispersion absorbs sensible heat from the first split gas stream. In the subject run, the naphtha and water are completely vaporized. There is substantially no cracking of the naphtha. There is no external heating of the vaporizer. There is substantially no pressure drop in the vaporizer.

The gaseous dispersion from vaporizer 108 is contacted in hot oil scrubber 112 with 421 lbs. of vacuum resid of 8.8 degrees API and substantially the same composition as previously described for the hydrocarbonaceous fuel. A vacuum resid-carbon dispersion is produced and separated by gravity from the remaining gaseous stream in gas-liquid separator 4. Advantageously, this dispersion may be recycled to the gas generator as the fuel feed or a portion thereof. In order to avoid naphtha losses, the temperature and pressure of the hot oil scrubber and gas-liquid separator are substantially the same as that in the vaporizer. The gaseous stream leaving separator 4 is cooled to a temperature of 75°-150° F. to condense out and separate in separator 129, a mixture of naphtha and water from 6.05 thousand standard cubic feet of clean dewatered product gas having the composition shown in Column 3 of Table I. This gas stream may be employed as synthesis gas. The naphtha-water mixture is separated into 628.5 lbs. of naphtha which is recycled to decanter 78 and 108 lbs. of water which is recycled to quench drum 33.

Advantageously, naphtha may be recovered from the naphtha-carbon-water dispersion for reuse in the decanter by the subject method with a savings of at least 10% of the thermal energy requirements, in comparison with conventional naphtha recovery methods such as by distillation.

TABLE I

| GAS COMPOSITION | | | |
|---|---|---|---|
| Column No. | 1 | 2 | 3 |
| Drawing Reference No. | 18 | 28 | 25 |
| COMPOSITION MOLE % | | | |

TABLE I-continued

| GAS COMPOSITION | | | |
|---|---|---|---|
| Column No. | 1 | 2 | 3 |
| Drawing Reference No. | 18 | 28 | 25 |
| CO | 38.03 | 25.25 | 43.94 |
| $H_2$ | 38.34 | 25.46 | 44.31 |
| $CO_2$ | 6.35 | 4.22 | 7.34 |
| $H_2O$ | 13.57 | 42.61 | 0.13 |
| $CH_4$ | 3.34 | 2.21 | 3.85 |
| Ar | 0.06 | 0.04 | 0.07 |
| $N_2$ | 0.03 | 0.02 | 0.03 |
| $H_2S$ | 0.28 | 0.19 | 0.33 |
| COS | 0.00 | 0.00 | 0.00 |

The process of the invention has been described generally and by examples with reference to a hydrocarbonaceous fuel,. synthesis gas and fuel gas of particular compositions for purposes of clarity and illustration only. It will be apparent to those skilled in the art from the foregoing that various modification of the process and materials disclosed herein can be made without departure from the spirit of the invention.

I claim:

1. In a process for the partial oxidation of a hydrocarbonaceous feedstock with a free oxygen-containing gas in the reaction zone of a free-flow noncatalytic partial oxidation gas generator at a temperature in the range of about 1700° F. to 3500° F. and a pressure in the range of about 5 to 300 atmospheres in the presence of a temperature moderator to produce a hot raw effluent gas stream comprising $H_2$, CO, $CO_2$, entrained particulate carbon and at least one material from the group $H_2O$, $N_2$, Ar, $H_2S$, COS, $CH_4$, and ash; and cooling and cleaning the process gas stream; the improved method for simultaneously producing a clean dewatered gas stream and a clean gas stream saturated with $H_2O$, and for recovering the particulate carbon from said effluent gas stream comprising;

(1) splitting all of the hot raw effluent gas stream leaving the reaction zone into first and second hot raw gas streams wherein the first hot raw gas stream comprises in the range of about 5 to 50 volume percent of all of the effluent gas stream and the second hot raw gas stream comprises the remainder;

(2) cooling and cleaning the second hot raw gas stream from (1) by direct contact with water thereby removing the solid particles entrained therein, and producing a carbon-water dispersion;

(3) mixing the carbon-water dispersion from (2) with a liquid organic extractant, and separating in a decanting zone a stream of liquid organic extractant-carbon-water dispersion at a temperature in the range of about 180° F. to 650° F. and a pressure in the range of about 75 to 4500 psig., and a stream of clarified water;

(4) scrubbing the gas stream from (2) with water comprising at least a portion of the clarified water from (3) to produce a clean gas stream saturated with $H_2O$;

(5) introducing into a vaporizing zone the first hot raw gas stream from (1) at substantially the same temperature and pressure as that in the reaction zone of the gas generator less ordinary losses of temperature and pressure in the lines; directly contacting and mixing in said vaporizing zone at substantially the same pressure as that in the reaction zone of the gas generator less ordinary pressure drop in the lines said first hot raw gas stream and the stream of liquid organic extractant-carbon-water dispersion from (3); vaporizing in said vaporizing zone substantially all of the liquid organic extractant and water in said dispersion to produce a gaseous stream comprising said first raw gas stream, vaporized liquid organic extractant, $H_2O$, and entrained particulate solids;

(6) contacting said gaseous stream leaving the vaporizng zone in (5) with a liquid hydrocarbon fuel scrubbing fluid in liquid phase in a gas scrubbing zone thereby coating the carbon particles with said liquid hydrocarbon fuel scrubbing fluid;

(7) separating by gravity in a separating zone a liquid phase dispersion of particulate carbon and liquid hydrocarbon fuel scrubbing fluid from said gaseous stream; and (8) cooling the gaseous stream leaving said separating zone in (7) to a temperature below the dew point of said $H_2O$ and said vaporized liquid organic extractant, whichever is lower, and in a separating zone separating from each other water, liquid organic extractant, and a clean dewatered gas stream.

2. The process of claim 1 where the liquid hydrocarbon fuel scrubbing fluid is introduced into the gas scrubbing zone at a temperature in the range of about 300° to 700° F.

3. The process of claim 1 where the scrubbing operation in (6) takes place at a temperature above the dew point of the liquid organic extractant or $H_2O$ whichever is greater and below the initial boiling point of the liquid hydrocarbon fuel scrubbing fluid.

4. The process of claim 1 provided with the step of introducing said liquid phase dispersion of particulate carbon and liquid hydrocarbon fuel scrubbing fluid from (7) into the partial oxidation gas generator as at least a portion of the hydrocarbonaceous feed.

5. The process of claim 1 provided with the step of recycling at least a portion of the liquid organic extractant from the separating zone in (8) to the decanting zone in (3).

6. The process of claim 1 in which the liquid hydrocarbon fuel scrubbing fluid in (6) is selected from the group consisting of fluid residua from petroleum distillation and cracking process operations, petroleum distillate, reduced crude, whole crude, asphalt, coal tar, coal derived oil, shale oil, tar sand oil, and mixtures thereof.

7. The process of claim 1 in which said liquid hydrocarbon fuel scrubbing fluid is a pumpable slurry in admixture with particulate carbon and/or petroleum coke.

8. The process of claim 1 in which said hydrocarbonaceous feedstock comprises at least in part a liquid hydrocarbon selected from the group consisting of liquified petroleum gas, petroleum distillates and residua, gasoline, naphtha, kerosine, crude petroleum, asphalt, gas oil, residual oil, tar sand oil and shale oil, coal derived oil, aromatic hydrocarbons (such as benzene, toluene, xylene fractions), coal tar, cycle gas oil from fluid-catalytic-cracking operation, furfural extract of coker gas oil, and mixtures thereof.

9. The process of claim 1 in which said hydrocarbonaceous feedstock comprises a pumpable slurry of solid carbonaceous fuel, such as coal, particulate carbon, petroleum coke, concentrated sewer sludge, and mixtures thereof, in a vaporizable liquid carrier, such as water, liquid hydrocarbon fuel, and mixtures thereof.

10. The process of claim 1 in which said hydrocarbonaceous feedstock comprises a gaseous hydrocarbon fuel with or without admixture with a liquid hydrocarbon and/or a solid carbonaceous fuel and said gaseous hydrocarbon fuel is selected from the group consisting of methane, ethane, propane, butane, pentane, natural gas, water-gas, coke-oven gas, refinery gas, acetylene tail gas, ethylene off-gas, synthesis gas, and mixtures thereof.

11. The process of claim 1 in which said hydrocarbonaceous fuel comprises at least in part an oxygenated hydrocarbonaceous organic material selected from the group consisting of oxygenated hydrocarbonaceous organic materials including carbohydrates, cellulosic materials, aldehydes, organic acids, alcohols, ketones, oxygenated fuel oil, waste liquids and by-products from chemical processes containing oxygenated hydrocarbonaceous organic materials, and mixtures thereof.

12. The process of claim 1 in which said temperature moderator is selected from the group consisting of steam, water, $CO_2$-rich gas, nitrogen, and recycled synthesis gas.

13. The process of claim 1 in which said free-oxygen containing gas is selected from the group consisting of air, oxygen-enriched air, i.e. greater than 21 mole % $O_2$, and substantially pure oxygen, i.e. greater than about 95% mole oxygen.

14. The process of claim 1 in which said liquid organic extractant is selected from the group consisting of (1) light liquid hydrocarbon fuels having an atmospheric boiling point in the range of about 100° F. to 450° F., density in degrees API in the range of over 20 to about 100, and a carbon number in the range of about 5 to 16; (2) a mixture of substantially water insoluble liquid organic by-products from an oxo or oxyl process comprising at least one alcohol, at least one ester and at least one constituent from the group consisting of aldehydes, ketones, ethers, acids, olefins, and saturated hydrocarbons; and, (3) mixtures of types (1) and (2).

15. The process of claim 1 in which said liquid organic extractant is selected from the group consisting of butanes, pentanes, hexanes, toluol, natural gasoline, gasoline, naphtha, gas oil, and mixtures thereof.

16. The process of claim 1 in which the clean gas stream saturated with $H_2O$ in (4) and the clean dewatered gas stream in (8) are produced at substantially the same pressure as that in the gas generator less ordinary pressure drop in the lines and equipment.

* * * * *